United States Patent [19]

Novo

[11] Patent Number: 4,685,373

[45] Date of Patent: Aug. 11, 1987

[54] MUSICAL INSTRUMENT

[76] Inventor: Juan Novo, 12440 SW. 188 Ter., Miami, Fla. 33177

[21] Appl. No.: 849,262

[22] Filed: Apr. 7, 1986

[51] Int. Cl.[4] ..... G10D 7/02

[52] U.S. Cl. ..... 84/464 A; 84/384

[58] Field of Search ..... 84/380, 384, 464 A, 84/477 B

[56] References Cited

U.S. PATENT DOCUMENTS

| | | | |
|---|---|---|---|
| 3,324,755 | 6/1967 | Canonico | 84/267 |
| 3,943,815 | 3/1976 | Gilbert | 84/293 |
| 4,106,079 | 8/1978 | Drury | 84/422 S X |

*Primary Examiner*—Lawrence R. Franklin

*Attorney, Agent, or Firm*—John Cyril Malloy

[57] ABSTRACT

A musical instrument of the flute type having a body with the conventional elongated configuration and a hollow interior extending along the length of the body wherein the body is formed of a main body portion, foot portion and head portion, which, depending upon the embodiment of the subject invention, may be permanently secured to one another or removable from another and further wherein the material from which the body, including each of the aforementioned portions is formed is a light transmitting material. An illumination means is mounted in an applicable location such as on a crown portion affixed to a proximal end of the body substantially adjacent the mouth piece but spaced therefrom wherein activation of the illumination means directs one or more beams of light into the wall structure of the body and wherein the light is "transmitted" through each of the succeeding head, body and foot portions due to the abutting positioning of the wall segments of these portions to one another and the introduction of light to the head portion.

15 Claims, 18 Drawing Figures

MUSICAL INSTRUMENT

BACKGROUND OF THE INVENTION

1. Field of the Invention

A musical instrument formed of acrylic or like material capable of "transmitting" light along its length from an activated light source secured at one end of a flute or light instrument by a crown portion which directs light at one or more locations directly into the wall structure formed of a light transmitting material.

2. Description of the Prior Art

Musical instruments of the flute type, or wind instruments have been known and used by man for hundreds of years. The modern-day flute instrument is generally structured from a metallic material and has an elongated configuration with a hollow interior extending along its length. In conventional form, such instruments include one or more key assemblies each including a plurality of keys disposed and structured to be manipulated by the fingers of a player so as to be movable into and out of covering relation to the plurality of apertures formed on the body of the instrument, along its length and communicating with the hollow interior. The exiting of "wind" or air blown into the interior of the flute body, by the player, through a mouth piece and blow hole is regulated in its exiting by selectively covering and opening predetermined ones of the holes formed in the body. In this fashion, the sound of the exiting air from the interior of the flute is varied and various notes may be produced resulting in the intended music.

While the tonal quality of modern-day flutes and like wind instruments is very satisfactory based in part on the material from which the flute is formed, such instruments are considered to be relatively fragile in that damage is easily done to such instruments unless extreme care is taken during use, transportion and storage.

In order to vary and in some instances enhance the appearance of musical instruments, the prior art contains structures which include the addition of some type of illumination to the musical instrument structure. Specifically, the U.S. Pat. No. 3,943,815 to Gilbert, and U.S. Pat. No. 4,091,706 to Ludwig, each disclose musical instruments, namely a guitar and a drum structure which incorporate certain illuminating devices which accents certain structural features of the respective instruments. However, the illuminating devices used in these prior art instruments are generally intended to accentuate only a portion of the instrument rather than accomplish illumination of the entire instrument. It would be desirable to have available a wind-type instrument, such as a flute, structured of a substantially transparent or translucent material which is capable of "transmitting" light and further including an illumination assembly which is specifically structured to adequately illuminate substantially the entire instrument while at the same time structuring the instrument to have superior tonal quality, at least equal to modern-day wind instruments of conventional design and structure.

SUMMARY OF THE INVENTION

The present invention relates to a musical instrument, preferably in the form of a flute but generally relating to any wind-type instrument. The flute structure of the present invention comprises a conventionally shaped elongated body having a cylindrical wall section surrounding an elongated hollow interior extending along the length of the body between oppositely disposed proximal and distal ends. The body comprises a main body portion having substantially the longest longitudinal dimension and being attached at the distal end of the body to a foot portion. The opposite end of the main body portion is connected to a head portion which contains a mouth piece and blow hole assembly for a player to provide forced air into the hollow interior, again, in a conventional fashion. The various portions of the body may be permanently secured to one another or integrally formed so as to have a one-piece body defined by the various fixedly or integrally secured portions. Also, the body portion may be removably secured to one or both of the foot portion and head portion at a foot joint and head joint, respectively. Each of the head joint and foot joint may be defined by a projecting finger and receiving socket structure cooperatively dimensioned to be removably secured to one another. An important feature of the present invention is the forming and structuring of each of the body sections from a transparent or translucent plastic or like synthetic material which is specifically structured to be capable of "transmitting" or conveying light throughout its length. The term "transmitting", as used herein, of course does not mean to include or describe any generating qualities of the material but merely the ability to allow illumination to pass along its length. Further, each of the sections are joined to one another such that correspondingly positioned wall segments defining the wall structure of the body are disposed in firm, abutting relation to one another such that light generated from a light assembly at one end of the head portion will travel along the length of the head portion and directly into the body portion as well as the foot portion due to the fact that adjoining wall segments of each of the portions of the body are disposed in the aforementioned abutting relation to one another.

The light assembly itself may be considered part of a crown portion of the subject invention wherein the light assembly is structured to be secured to the extremity of the proximal end. The specific structure or source of light may vary and include an array of light-emitting diodes (LED) or alternately a laser generating structure communicating with the proximal end or base of the light assembly by a fiber bundle or other applicable means.

The invention accordingly comprises the features of construction, a combination of elements and arrangement of parts which will be exemplified in the construction hereinafter set forth, and the scope of the invention will be indicated in the claims.

BRIEF DESCRIPTION OF THE DRAWINGS

For a full understanding of the nature of the present invention, reference should be made to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
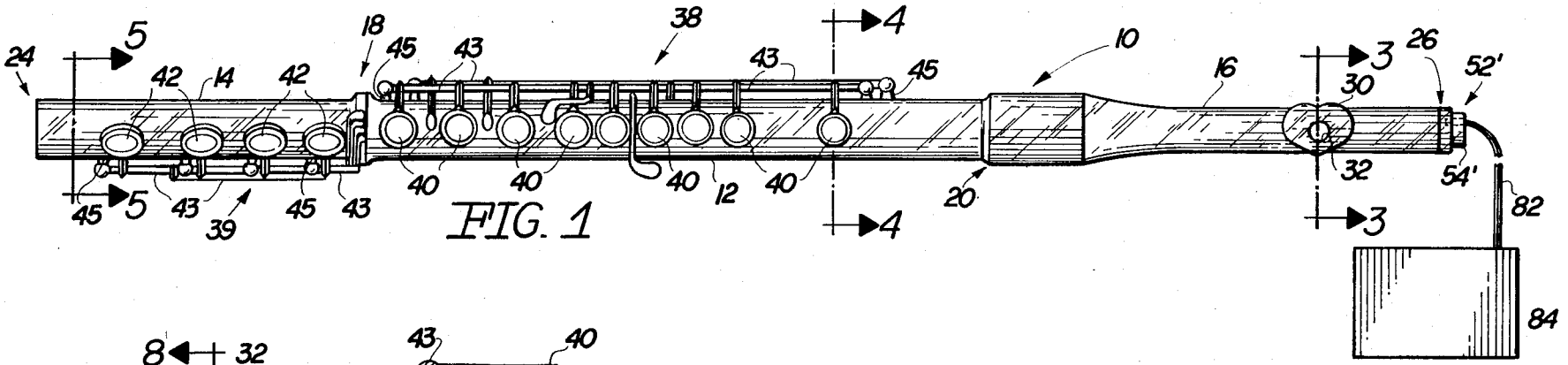
FIG. 1 is a front plan view of the musical instrument, in the form of a flute of the present invention.
Figure 2:
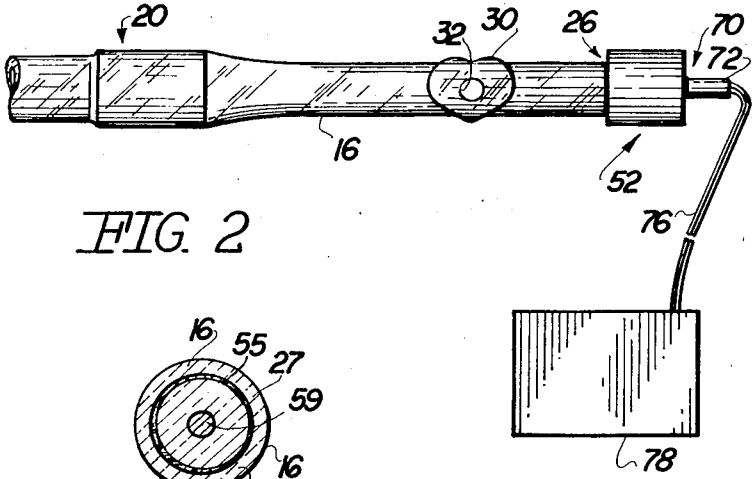
FIG. 2 is front plan view in partial cutaway of another embodiment of the present invention differing in the structural design and operation of a light assembly associated therewith.
Figure 3:
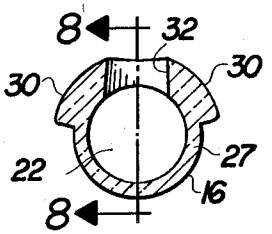
FIG. 3 is a sectional view along line 3—3 of FIG. 1.

As shown in FIG. 1, the present invention is directed to musical instruments, such as a flute, as generally indicated as 10, having a substantially conventional, elongated configuration defined by a cylindrical wall structure. The body of the flute 10 is defined by a main body portion 12, a foot portion 14 and a head portion 16. The various portions of the body 12, 14 and 16 may be fixedly or even integrally secured to one another or alternately, in a preferred embodiment, the body of the flute may be defined by detachable portions 12, 14 and 16. In the preferred embodiment the foot portion 14 is removably secured to the main body portion 12 at a foot joint generally indicated as 18. Similarily, the main body portion 12 is removably secured to the head portion at head joint generally indicated as 20. The body of flute 10 also includes a hollow interior 22 extending along its length between a distal end generally indicated as 24 and defined by an extremity of the foot portion 14 and a proximal end generally indicated as 26 and defined by one free extremity of the head portion 16.

An important feature of the present invention is the formation of the wall structure of the body of flute 10 from a preferably transparent but possibly translucent material which is synthetic and specifically structured to be capable of "transmitting" light therethrough and along the length thereof. More specifically, the material may be a synthetic acrylic material or any other material that is capable of including the formation of the structures while at the same time capable of transmitting or carrying light from an illumination assembly, to be described in greater detail hereinafter, throughout the length of the instrument. Therefore, it is seen, when the various portions 12, 14 and 16 are removably secured to one another, the wall structure of flute 10 is composed of wall segments 27 defining the wall structure of head portion 16, wall segment 28 defining the wall structure of the main body portion 12 and wall segment 29 defining the wall structure of the foot section 14.

Figure 4:
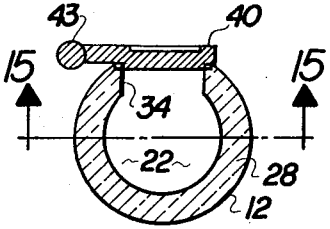
FIG. 4 is a sectional view along line 4—4 of FIG. 1.
Figure 5:
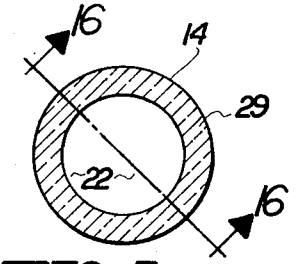
FIG. 5 is a sectional view along line 5—5 of FIG. 1.
Figure 6:
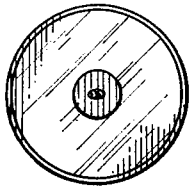
FIG. 6 is a sectional view along line 6—6 of FIG. 9.
Figure 7:
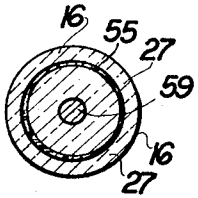
FIG. 7 is a sectional view along line 7—7 of FIG. 9.

Further structure of the subject flute 10 which enables the substantially conventional operation includes a mouth piece 30 and associated blow hole 32 structured to allow forced air, from the player to enter the interior (FIG. 8) of the head portion 16 and from there travel towards the opposite or distal end 24 throughout the formed bore defining the hollow interior 22. With reference primarily to FIGS. 1, 4, 15 and 16, the forced air,. from the player passing through blow hole 32 passes along the interior bore towards distal end 24 and exits through such open distal end or alternately through a plurality of apertures including a first grouping integrally formed in the main body portion 12 and a second grouping integrally formed in the foot portion 14. The apertures 34 of the main body portion 12 are each disposed in cooperative position with a first key assembly 38. Similarly, a second key assembly 39 is disposed in cooperative relation to the apertures 37 integrally formed in the foot portion 14. Each key assembly 38 and 39 comprises a plurality of keys equal in number to the number of apertures and selectively positionable into and out of sealing engagement with the respective apertures as best shown in FIG. 4. The plurality of keys 40 of the first key assembly 38 overlie and regulate air flow out of the various apertures 34. Similarly, the plurality of keys 42 overlie and regulate air flow from the plurality of apertures 37 in the foot portion 14. The keys are manipulated by the fingers of the player and are similar to conventional key assembly structures. In addition, each of the key assemblies 38 and 39 include elongated support rods 43 secured to the external surface of the respective main body portion 12 and foot portion 14 by a plurality of support posts 45 (see FIGS. 1, 17 and 18). Each of the support posts has a depending lower end 47 designed to be secured within appropriately formed apertures in the wall segments of the respective main body portion 12 and foot portion 14 (not shown). The upper end includes a ball-like configuration as at 49 having a mounting aperture 46 formed therein. A brass or like material bushing 48 has its exterior surface knurled or otherwise roughened as shown at 50 and therefore press fitted into the interior of the mounting aperture 46. A screw-like structure 100 is externally threaded and designed to fit within the interior of the bushing 48 which itself is internally threaded for mating engagement with the screw element 100. As can be readily seen, the screw element has one end with a substantially pointed or conical configuration at 101. Such pointed end serves to matingly and supportingly engage the extremity of the supporting rods 43 so as to maintain them in the proper orientation as shown in FIG. 1. Accordingly, the support posts 45 are disposed at spaced location to one another along the length of the support rods 43 and in attached relation thereto including positioning of the support posts 45 at opposite ends of the support rods 43.

Figures 8, 9, 10, 11, 12, 13, 14:
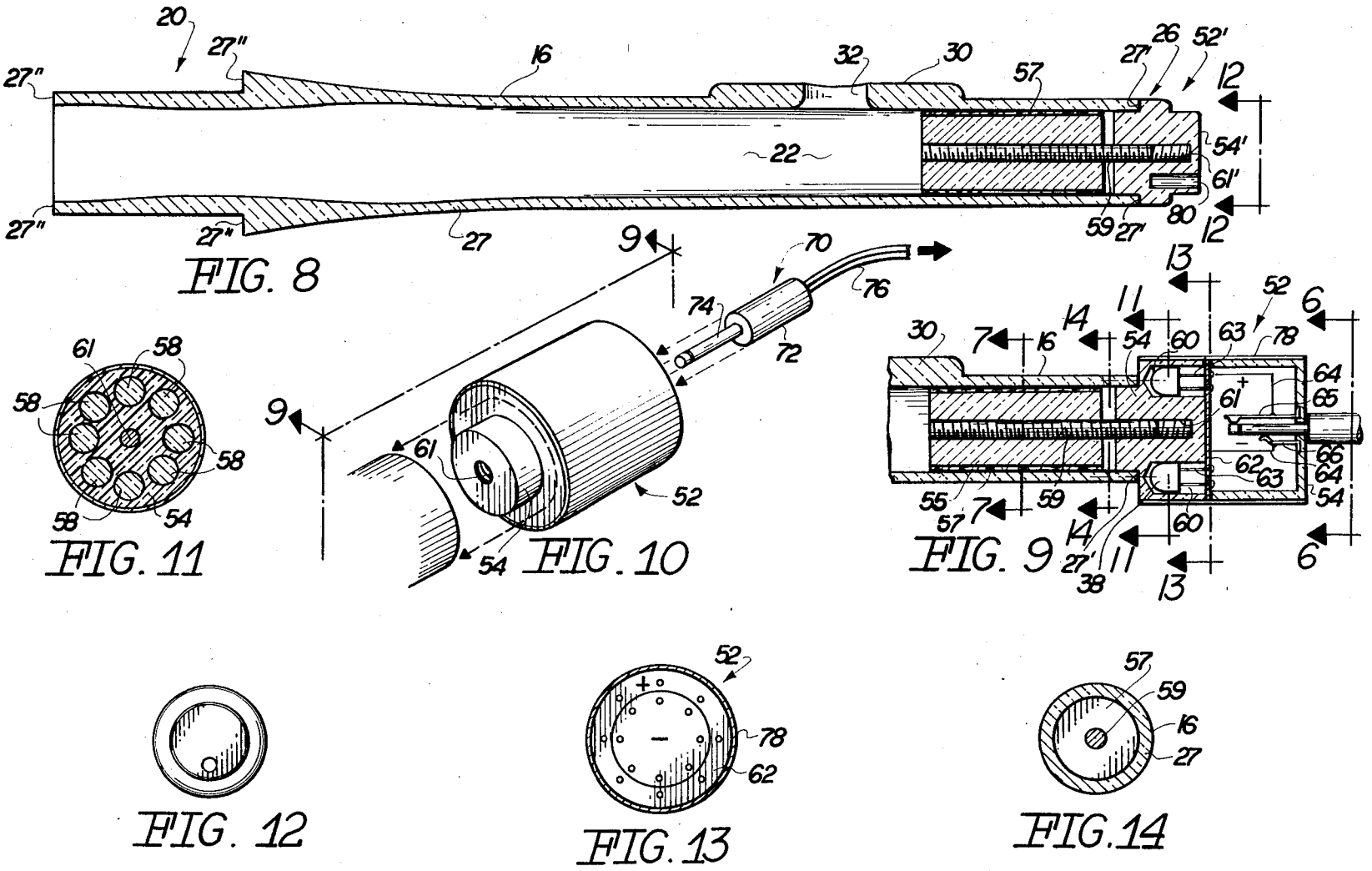
FIG. 8 is a sectional view along line 8—8 of FIG. 3.
FIG. 9 is a sectional view in partial cutaway of the light assembly embodiment as represented in FIG. 2.
FIG. 10 is a perspective view in partial cutaway and exploded form of the embodiment of FIG. 9.
FIG. 11 is a sectional view along line 11—11 of FIG. 9.
FIG. 12 is an end view along line 12—12 of FIG. 8.
FIG. 13 is a sectional view along line 13—13 of FIG. 9.
FIG. 14 is a sectional view along line 14—14 of FIG. 9.

Another important feature of the present invention is best seen in FIGS. 1, 2 and 8–14. More specifically, the subject invention includes an illumination assembly generally indicated as 52 (FIG. 9) and in a different embodiment as 52' (see FIG. 8). The illumination assembly 52 includes a base 54 having one end reduced to the interior diameter of the extremity of proximal end portion 26 so as to at least partially fit therein. A plug structure 55 is made of a similar acrylic, transparent material which allows light to be transmitted therethrough and is disposed within the interior of proximal end 26 so as to close off any air passage and prevent air issuing from the player after entering through blow hole 32 from passing out through proximal end 26. The plug structure 55 includes an elongated connector element defined by an externally threaded rod 59 extending substantially through the entire length of the plug structure 55. The length of the threaded rod 59 as to protrude outwardly from one end of the plug structure 55 for removable attachment by placement within internally threaded socket 61 as best shown in FIGS. 8 and 9. Further structural features of the plug 55 include the external surface thereof, between the end being wrapped with a material such as cork 57 so as to insure a sealed, tight engagement between the interior of the member 16 and the plug 55 itself.

Further with regard to the embodiment of FIG. 9, the base 54 is also made from a light transmitting material and includes a plurality of sockets disposed in a substantially circular array and generally adjacent to the periphery thereof and in surrounding relation to the centrally located threaded socket 61. Each of these sockets 60 is dimensioned and disposed to receive therein a light element which in the embodiment of FIG. 9 comprises a plurality of light-emitting diodes 58 arranged in a circular array about the central axis which is colinear with the connector 59. A connector plate 62 is electrically connected to electrode or conductor structures 63 associated with each of the LEDs 58 and further conductor means 64 are electrically interconnected with positive and negative contacts 65 and 66, respectively.

Figures 15, 16, 17, 18:
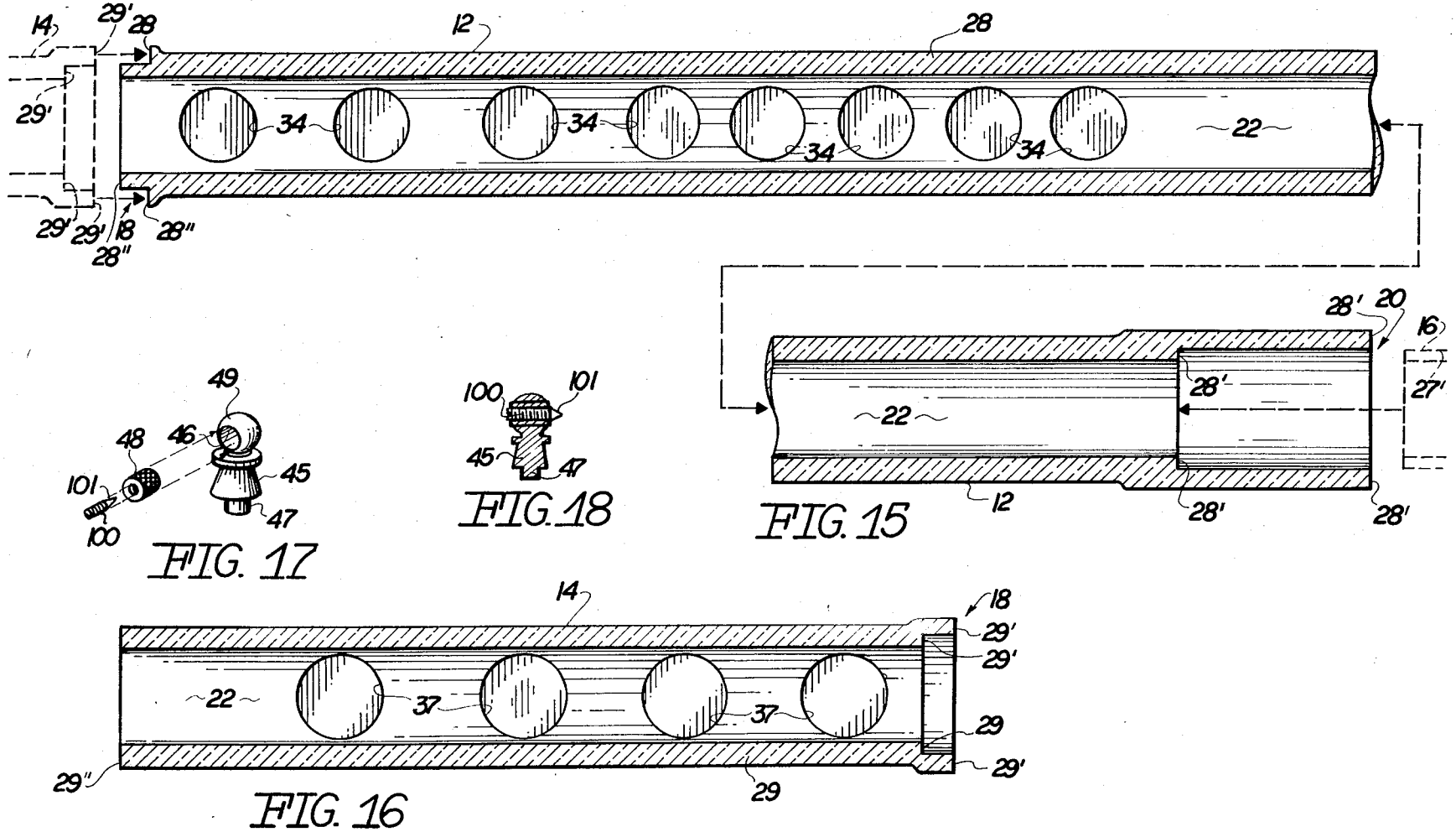
FIG. 15 is a sectional view in partial cutaway of a body portion of the subject flute structure and its relative positioning to the other portions of the body of the flute wherein the other portions are represented in phantom lines.
FIG. 16 is a sectional view along line 16—16 of FIG. 5 showing structural details of a foot portion of the present invention.
FIG. 17 is a perspective view in partially exploded form of a support post and attached bushing relating to a key assembly of the present flute structure.
FIG. 18 is a sectional view showing the structure of FIG. 17 in assembled form.

Contacts 65 and 66 are positioned for electrical engagement with a connector jack generally indicated as 70 and including a base portion 72 an outwardly protruding finger or contact 74. The connector jack 70 is connected by conventional conductor structure 76 to an electrical power supply 78 which could be a portably packaged battery assembly (see FIG. 2). In addition to the above, a light shield type device or coating 78 is provided around the exterior surface of the base so as to prevent light from emanating therethrough. Accordingly, when activated by power supply 78, current illuminates the plurality of LEDs 58. This in turn transmits light throughout the base 54 forward and laterally of the LEDs. In addition, due to the abutting connection of the extremity of the wall segment 27 as at 27', light is transmitted along the length of the wall segment 27 of the head portion 16 as well as along the length of the interior 22. Transmission of the light along the length of the head portion 16 causes the light to effectively pass through the junction of the head joint between the head portion and the body portion 16 and 12, respectively. More specifically, as shown in FIGS. 8 and 15 the light continues to pass along the length of the head portion 16 and emanate from the opposite distal end as at 27'' as indicated in FIG. 8. The light is thereby received substantially at end portions 28' and accordingly passes through the length of the main body portion 12. Light is transmitted throughout the length of the instrument and along the interior as at 22 by virtue of the fact that the plug 55 is made of a transparent acrylic or light transmitting material as described above.

With reference to FIG. 15, the illumination being transmitted along the length of the main body portion 12 due to the material from which the wall segments, such as 28, are formed, allows passage of the light beyond the foot joint 18 and, due to the abutting engagement of end portion 28'', the light then continues to travel or be transmitted into the ends 29' of the foot portion 14. With reference to FIG. 16, the light thereby enters the appropriate end 29' of the junction 18 and transmits continuously along the length of the wall segment 29 until it reaches the opposite end as at 29''. The above-described transmission of light throughout the entire length of the body of flute 10 occurs whether the individual main body portion 12, foot portion 14 and head portion 16 are removably secured to one another at the various foot and head joints 18 and 20, respectively or whether the individual portions are fixedly secured together or are an integral one-piece construction. The abutting engagement or the placement of the corresponding extremities of the foot and head portion 14 and 16 relative to the body portion 12 facilitate the transmission of light through the wall structure by passing through each of the different wall segments 27, 28 and 29.

With regard to FIG. 12, a varying embodiment of the present invention includes the light assembly 52' having a base 54' secured to the elongated connector 59 in the manner described above wherein the base portion 54' has a receiving socket 80 designed to receive the transmitting end of a fiber bundle or like structure 82 (see FIG. 1) which directs and transmits light from a laser generating assembly 84 having its own power source (not shown for purposes of clarity). The generation or transmission of light throughout the length of the body of the flute 10 occurs in the manner just described with respect to the embodiment of FIG. 2.

It is therefore to be understood that the following claims are intended to cover all of the generic and specific features of the present invention herein described, and all statements of the scope of the invention which as a matter of language might be said to fall therebetween.

Now that the invention has been described, what is claimed is:

1. A musical instrument assembly of the wind type such as a flute and primarily designed to be illuminated, said instrument assembly comprising:

(a) an elongated body having a cylindrical wall structure and a hollow interior extending along the length of said body surrounded by the wall structure, said hollow interior extending between a proximal end and a distal end oppositely disposed to one another along the length of said body, (b) said body comprising a head portion and a foot portion disposed adjacent to said proximal end and said distal end, respectively and a main body portion secured in interconnecting relation between said head and foot portions, (c) a mouth piece and a blow hole formed in said head portion in substantially adjacent, spaced relation to said proximal end and structured for fluid communication with said hollow interior, (d) a key assembly movably mounted on an exterior of said body and cooperatively positioned in removable covering relation to an aperture assembly integrally formed in said body, whereby said key assembly is manipulated by fingers of a player to regulate exiting of air from the body through said aperature assembly, (e) a crown assembly removably secured to said head portion adjacent said proximal end and including an illumination means for directing light into said wall structure of said body at said head portion, (f) said wall structure of said body including said head portion, main body portion and said foot portion formed of a light transmitting material, whereby said body appears illuminated upon activation of said illumination means.

2. An assembly as in claim 1 wherein said illumination assembly comprises a plurality of light elements disposed in a substantially circular array and collectively disposed in aligned orientation with a correspondingly positioned extremity of said wall structure, whereby light is directed into said wall structure at locations surrounding said hollow interior.

3. An assembly as in claim 2 wherein said illumination assembly comprises a base, said plurality of light elements secured to said base in a substantially circular array about a periphery of said base.

4. An assembly as in claim 3 wherein said base comprises a connector plate electrically connected to said plurality of light elements on one side thereof and to an electrical power source.

5. An assembly as in claim 4 wherein said illumination assembly comprises said electrical power source and an electrical connector attached to said electrical power source by conductor means for carrying current, said electrical connector removably attachable to said base and into electrical connection with said connector plate and said plurality of light elements.

6. An assembly as in claim 5 wherein said electrical power source comprises a portably packaged battery assembly.

7. An assembly as in claim 1 wherein said main body portion is detachedly connected to said foot portion at a foot joint by means of a first mating finger and socket structure.

8. An assembly as in claim 7 wherein said main body portion is detachedly connected to said head portion at a head joint by means of a second mating finger and socket structure.

9. An assembly as in claim 8 wherein said wall structure is defined by cylindrically configured wall segments of said main body portion, foot portion and head portion each disposed in abutting engagement with the next adjacent wall segment.

10. An assembly as in claim 9 wherein said wall segments are cooperatively disposed and structured to transmit illumination at least partially along the length of said body through said light transmitting material.

11. An assembly as in claim 1 further comprising a plug structure formed of light transmitting material and comprising a substantially cylindrical configuration and mounted within said hollow interior adjacent said proximal end in spaced relation to said mouth piece and blow hole and in blocking relation to air exiting through said proximal end.

12. An assembly as in claim 11 wherein said illumination assembly comprises a base, said plurality of light elements secured to said base in a substantially circular array about a periphery of said base; said base connected to said plug structure and extending outwardly therefrom in substantially covering relation to said proximal end.

13. An assembly as in claim 12 further comprising a connector element secured to said plug structure and extending outwardly therefrom, said base attached to said connector element outwardly from said plug structure.

14. An assembly as in claim 13 wherein said connector element comprises an elongated externally threaded rod extending through a longitudinal center of said plug structure and extending at least partially through a longitudinal center of said base.

15. An assembly as in claim 1 wherein said key assembly comprises a plurality of support posts disposed in supporting relation to a plurality of keys by a support rod, each of said support posts including a finger defining a lower end thereof, said lower end affixed said body so as to extend outwardly therefrom; a mounting aperture formed in an upper end of each post and a connecting bushing fitted within said mounting aperture and being structured for connection to said support rod; a support post secured in spaced relation to one another along the length of each support bar.

* * * * *